US010739725B2

(12) United States Patent
Nagata

(10) Patent No.: US 10,739,725 B2
(45) Date of Patent: Aug. 11, 2020

(54) IMAGE FORMING APPARATUS

(71) Applicant: CANON KABUSHIKI KAISHA, Tokyo (JP)

(72) Inventor: Naohisa Nagata, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/698,081

(22) Filed: Nov. 27, 2019

(65) Prior Publication Data

US 2020/0174424 A1 Jun. 4, 2020

(30) Foreign Application Priority Data

Nov. 29, 2018 (JP) ..... 2018-224212
Nov. 14, 2019 (JP) ..... 2019-206512

(51) Int. Cl.
*G03G 21/20* (2006.01)

(52) U.S. Cl.
CPC ..... *G03G 21/206* (2013.01)

(58) Field of Classification Search
None
See application file for complete search history.

(56) References Cited

U.S. PATENT DOCUMENTS 5,784,668 A * 7/1998 Hyakutake ..... G03G 15/0121 399/40
2006/0099001 A1* 5/2006 Asakura ..... G03G 15/2042 399/69
2014/0294409 A1* 10/2014 Murata ..... G03G 15/161 399/44
2014/0348522 A1* 11/2014 Tomono ..... G03G 15/50 399/44
2019/0064714 A1* 2/2019 Nishimura ..... G03G 15/2017
2019/0121289 A1* 4/2019 Maeda ..... G03G 15/75

FOREIGN PATENT DOCUMENTS

JP 2015-087466 A 5/2015

* cited by examiner

*Primary Examiner* — Sevan A Aydin
(74) *Attorney, Agent, or Firm* — Venable LLP

(57) ABSTRACT

An image forming apparatus includes an image forming unit including a photosensitive drum, a developing device, a temperature detector for detecting an environment temperature; a storage storing accommodate sheets, wherein a heating unit for heating the sheets is detachably mountable to the storage; a cooling unit for cooling the developing device; a controlling unit for operating the cooling unit in response to an output of the temperature detection unit. When the heating unit is not mounted in the storage, the controlling unit actuates the cooling unit in response to a first temperature detected by the detector. When the heating unit is mounted in the storage, the controlling unit actuates the cooling unit in response to a second temperature detected by the detector. The second temperature is lower than the first temperature.

20 Claims, 9 Drawing Sheets

| 801 STATES | 802 PROCESS SPEEDS | 803 COLOR MODES | 804 CX [℃] | 805 K |
|---|---|---|---|---|
| IMAGE FORMING OPERATION | 1/1 | FULL COLOR | 20.0 | 0.19 |
| | | MONOCHROMATIC | 16.2 | 0.22 |
| | 1/2 | FULL COLOR | 9.5 | 0.15 |
| | | MONOCHROMATIC | 9.3 | 0.15 |
| | 1/3 | FULL COLOR | 8.1 | 0.17 |
| | | MONOCHROMATIC | 8.0 | 0.17 |
| STAND-BY | | | 4.0 | 0.02 |
| SLEEP | | | 1.0 | 0.02 |

Fig. 7A

[UNIT: ℃]

| | FEEDER 28A | FEEDER 28B | FEEDER 28C |
|---|---|---|---|
| CASSETTE HEATER | 5.9 | 3.0 | 1.3 |
| ENVIRONMENT HEATER | 5.5 | 2.5 | 0.9 |

Fig. 7B

[UNIT: °C]

| | FEEDER 28A | FEEDER 28B | FEEDER 28C |
|---|---|---|---|
| CORRECTION BY HEAT OF SHEETS: $\alpha$ | 0.03 | 0.02 | 0.01 |

Fig. 9

IMAGE FORMING APPARATUS

FIELD OF THE INVENTION AND RELATED ART

The present invention relates to an image forming apparatus such as a copying machine, a printer, a facsimile machine, and a multi-function machine having a plurality of these functions.

Conventionally, when a temperature in the neighborhood of a developing device rises, a temperature of the developer in the developing device rises and the developer may deteriorate.

Under the circumstances, in an image forming device disclosed in JP-A-2015-87466, the temperature in the neighborhood of the developing device is predicted from information from a temperature sensor in the device and a temperature sensor in the fixing device, when said predicted temperature reaches said threshold, a fan is driven, to suppress temperature rise of the developing device.

SUMMARY OF THE INVENTION

Problems to be Solved by the Invention

There is a structure in which a heater as a heating means can be mounted to and dismounted from a cassette as a recording material storage means for storing a recording material. When a heater is mounted to the cassette, a temperature of the developing device may rise due to the effect of heating action of the cassette heater. However, when the temperature in the neighborhood of the developing device is predicted from information only from the temperature sensor in the device as in JP-A-2015-87466, there is a risk that the temperature in the neighborhood of the developing device will rise above the predicted temperature, because the developing device is affected by the cassette heater. In this case, the fan cannot be controlled properly, and the temperature of the developing device rises, and therefore, in some cases, the developer deteriorates.

An object of the present invention is to provide a structure capable of suppressing deterioration of a developer due to an excessive rise in the temperature in the neighborhood of the developing device above the predicted temperature, in the structure in which the heating means can be mounted to and dismounted from the recording material storage means.

Means for Solving the Problem

According to an aspect of the present invention, there is provided an image forming apparatus capable of executing an image forming operation for forming an image on a recording material, said image forming apparatus comprising an image forming unit including a photosensitive member, a developing device capable of developing an electrostatic latent image formed on said photosensitive member with a developer, wherein the image provided by the development by said developing device is transferred onto a recording material; a temperature detector configured to detect an environment temperature at which said image forming apparatus is installed; an accommodating portion configured to accommodate recording materials to be fed to said image forming unit, wherein a heating unit configured to heat the recording material is detachably mountable to said accommodating portion; a cooling unit configured to cool said developing device; a controlling unit configured to execute a cooling operation of said cooling unit on the basis of a detection result of said temperature detection unit; wherein in a case that said heating unit is not mounted in said accommodating portion, said controlling unit executes the cooling operation of said cooling unit when the detection result of said temperature detector indicates a temperature not less than a first temperature, and in a case that said heating unit is mounted in said accommodating portion, said controlling unit executes the cooling operation when the detection result of said temperature detector indicates a temperature not less than a second temperature which is lower than the first temperature.

Further features of the present invention will become apparent from the following description of exemplary embodiments with reference to the mounted drawings.

BRIEF DESCRIPTION OF THE DRAWINGS

FIG. 7A is a table of predicted temperature rise convergent value Cx and a temperature fluctuation rate k in Embodiment 1.

FIG. 7B is a table of predicted correction temperature Cc in Embodiment 1.

FIG. 9 is a view illustrating a Table of correction values for the predicted correction temperature according to Embodiment 2.

DESCRIPTION OF EMBODIMENTS

Embodiment 1

Figure 8:
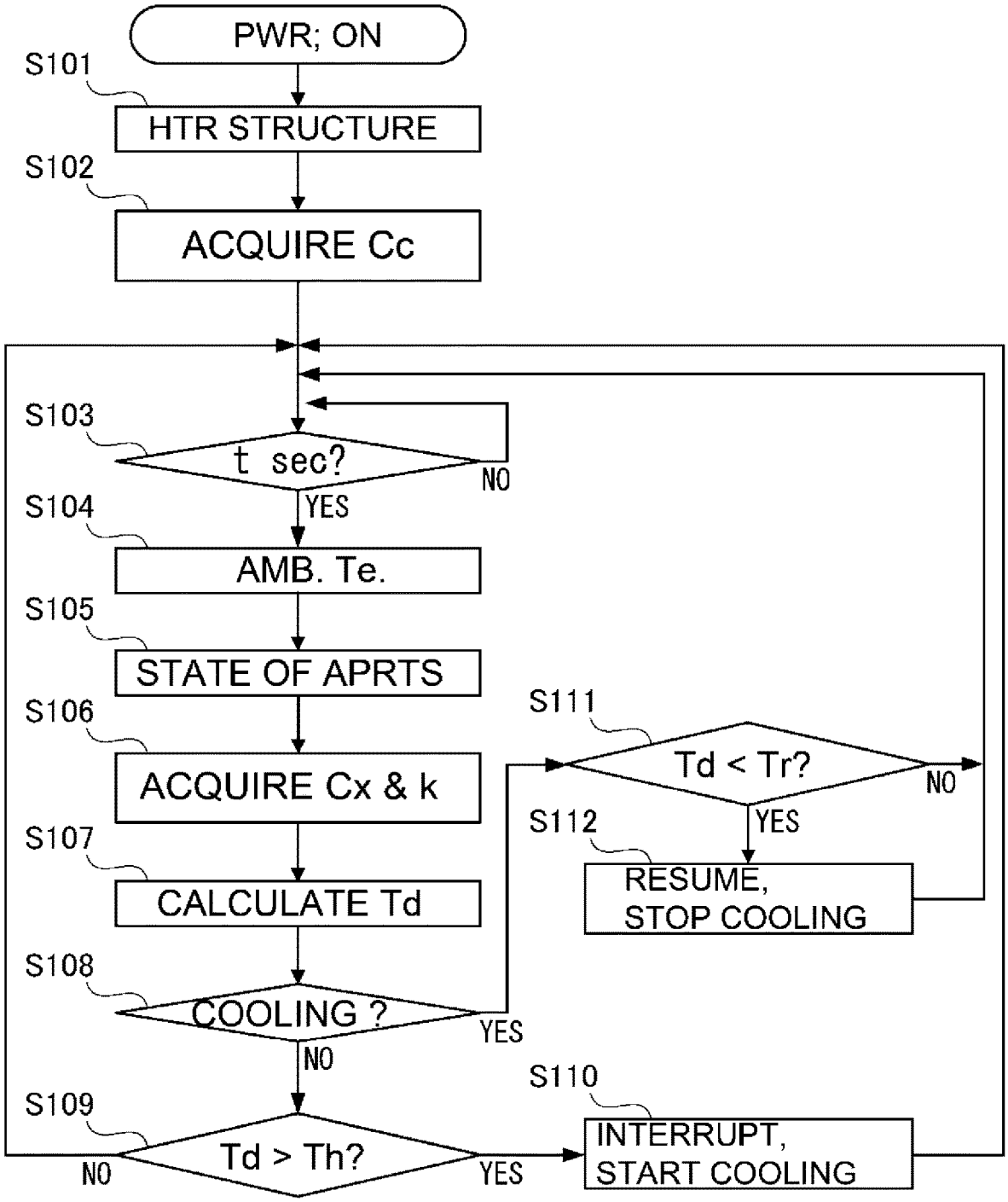
FIG. 8 is a flowchart of the temperature rise protection control according to Embodiment 1.

Referring to FIG. 8 Embodiment 1 will be described. First, referring first to FIG. 1, a schematic structure of an image forming apparatus of this embodiment will be described.

[Image Forming Apparatus]

The image forming apparatus 100 is a tandem intermediary transfer type image forming apparatus inw image forming stations PY, PM, PC, and PK are arranged in series along a rotational moving direction of an intermediary transfer belt 12. Such an image forming apparatus 100 forms a full-color image on a recording material 2 such as a sheet (paper, plastic sheet, and so on) by electrophotography, in accordance with an image signal fed from an external device such as a personal computer or an image signal from an original reader.

Such an image forming apparatus 100 can execute an image forming operation for forming an image on the recording material 2, and it includes an image forming portion 110, a fixing device 13, feeding units 28A, 28B, 28C, and so on which are arranged in the apparatus main assembly 101 to form the image on the recording material 2. The image forming portion 110 includes a plurality of image forming stations PY, PM, PC, PK, an exposure device 10, an intermediary transfer belt 12 as an intermediary transfer member, and the like. In the image forming stations PY, PM, PC, PK, yellow (Y), magenta (M), cyan (C), and black (K) toner images are formed.

Here, the four image forming stations PY, PM, PC, and PK of the image forming apparatus 100 have substantially the same structure except that the development colors are different. Therefore, hereinafter, the image forming station PY will be described as a representative, and other image forming station structures are indicated by replacing the suffix "Y" of the reference numerals with M, C, and K, respectively, and the description thereof is omitted for simplicity.

In the image forming station PY, a cylindrical photosensitive member, that is, a photosensitive drum 5Y is provided as an image bearing member. Around the photosensitive drum 5Y, a charging device 7Y as a charging portion, a developing device 8Y as a developing portion, a primary transfer roller 4Y as a primary transfer portion, and the like are arranged. In addition, an exposure device (laser scanner) 10 is provided below the photosensitive drum 5Y in the drawing. The position of the primary transfer roller 4Y can be changed by actuating a solenoid (not shown), so that the contact (contact) state and separation state of the intermediary transfer belt 12 and the photosensitive drum 5Y can be switched.

Figure 1:
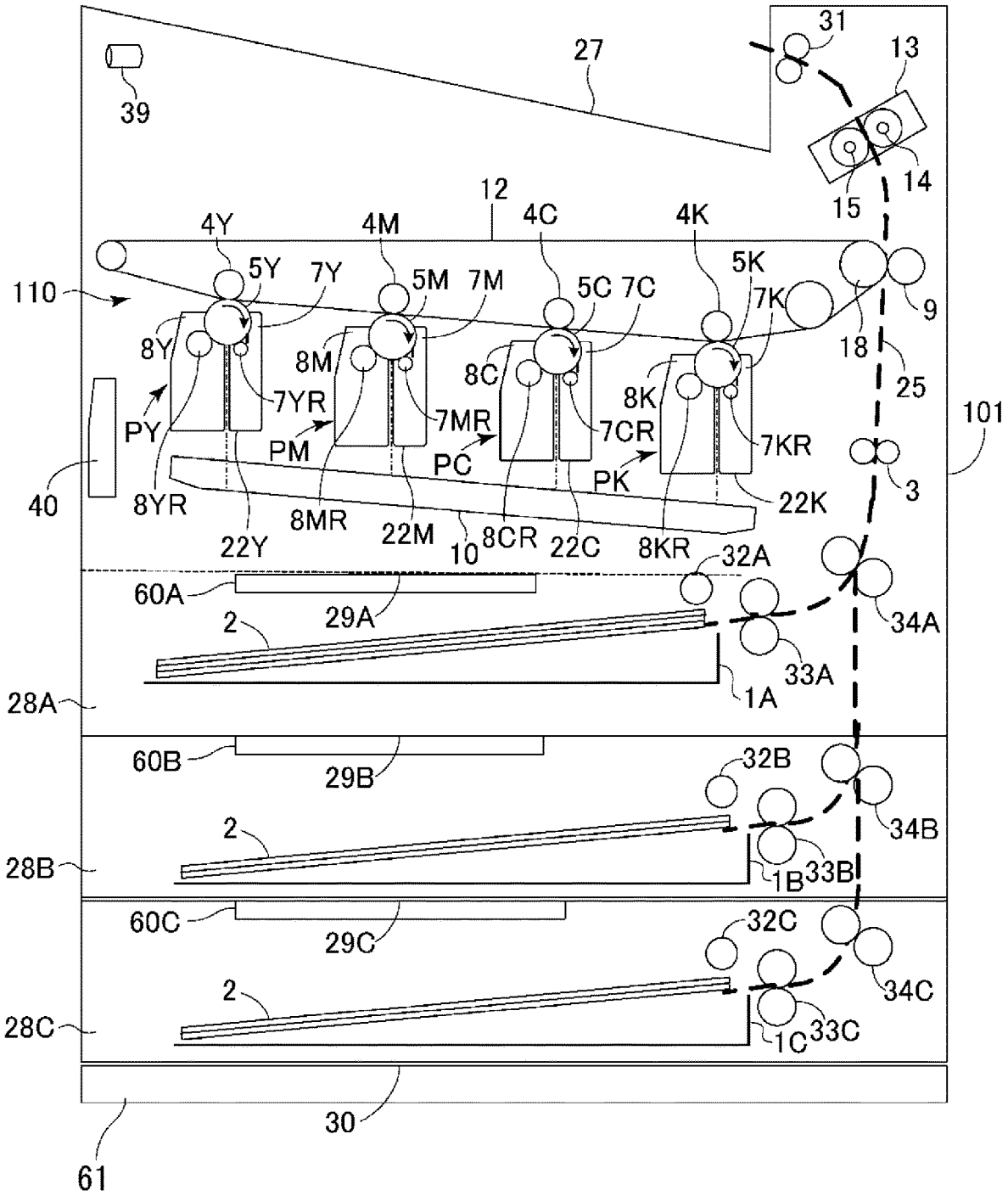
FIG. 1 is a schematic structure illustration of an image forming apparatus according to Embodiment 1.

The photosensitive drum 5Y is constituted by applying an organic photoconductive layer on an outer periphery of an aluminum cylinder, and is rotatable by receiving a driving force of a driving motor (not shown), that is, the drive motor rotates the photosensitive drum 5Y in the clockwise direction in FIG. 1 in the image forming operation. The charging device 7Y includes a charging roller 7YR which rotates in contact with the photosensitive drum 5Y to uniformly charge the surface of the photosensitive drum 5Y. The exposure device 10 irradiates the surface of charged photosensitive drum 5Y with exposure light (laser beam) to selectively expose the surface of photosensitive drum 5Y so that an electrostatic latent image is formed on the surface of the photosensitive drum 5Y.

The developing device 8Y can develop the electrostatic latent image formed on the surface of the photosensitive drum 5Y with a developer as described above. That is, the developing device 8Y accommodates toner as a developer and includes a developing roller 8YR. A developing roller 8YR as a developer carrying member is provided so as to face the photosensitive drum 5Y, and rotates carrying the developer in the developing device 8Y. And, the electrostatic latent image formed on the photosensitive drum 5Y is developed using the toner fed to the zone facing the photosensitive drum 5Y by the developing roller 8YR to provide a toner image.

During full color image formation, the intermediary transfer belt 12 rotates counterclockwise in contact with the photosensitive drums 5Y, 5M, 5C, and 5K, and receives the toner image of each color from the photosensitive drum by the primary transfer bias applied to the primary transfer rollers 4Y, 4M, 4C, and 4K. And, by nipping and feeding the recording material 2 at the position of the secondary transfer roller 9, a full color toner image is simultaneously superimposed and transferred onto the recording material 2.

On the other hand, during monochrome image formation, the intermediary transfer belt 12 rotates counterclockwise while being in contact only with the photosensitive drum 5K, and receives the toner image by a primary transfer bias applied to the primary transfer roller 4K. And, by nipping and feeding the recording material 2 at the position of the secondary transfer roller 9, a monochrome toner image is transferred onto the recording material 2. Here, the primary transfer rollers 4Y, 4M, 4C, 4K and the secondary transfer roller 9 rotate as the intermediary transfer belt 12 rotates.

The recording material 2 is stored in the feeding cassettes 1A, 1B, and 1C of the feeding portions 28A, 28B, and 28C as recording material storing means. And, recording material 2 is fed from the feeding cassettes 1A, 1B, and 1C to a registration roller pair 3 through the transport path 25 by the pickup roller 32A, 32B, 32C, the feed rollers 33A, 33B, 33C, and a pulling roller pair 34A, 34B, 34C. Furthermore, the recording material 2 is fed to the position of the secondary transfer roller 9 by the registration roller pair 3, and the toner image is transferred from the intermediary transfer belt 12 in synchronism with the timing of the toner image on the intermediary transfer belt 12, as described above.

Here, the feeding portion 28A is a standard feeder integrated with the image forming apparatus 100, the feeding portion 28B and the feeding portion 28C are optional feeders which can be mounted to and dismounted from the apparatus main assembly 101.

The fixing device 13 fixes the transferred toner image on the recording material while feeding the recording material 2 onto which the toner image has been transferred from the intermediary transfer belt 12. The fixing roller 14 and the pressure roller 15 are hollow rollers, and a heater is provided in the fixing roller 14, wherein the heater is controlled so that the temperature is suitable for the type of recording material 2 which is being processed. The recording material 2 carrying the toner image is fed by the fixing roller 14 and the pressure roller 15, and simultaneously the toner is fixed on the surface of the recording material by applying heat and pressure thereto. After the toner image is fixed, the recording material 2 is discharged to the discharge tray 27 by the discharge roller pair 31. By this, the image forming operation is completed.

In this series of image forming operations, the processing speed (image forming speed) differs depending on the type of recording material which is being processed. For example, if thin paper or plain paper is used as the recording material and the operation speed is 1/1 speed, the images are formed at ½ speed for the thick paper, and ⅓ speed for glossy paper.

In addition, the image forming apparatus 100 includes an environment sensor 39 as temperature detection means for detecting the temperature inside the apparatus main assembly. The environment sensor 39 is a sensor for detecting environmental information such as temperature and humidity of the place where the image forming apparatus 100 is installed, and the detection result is used to correct various high voltages for image formation and to predict the temperature in the neighborhood of the developing portion, as will be described hereinafter.

The image forming apparatus 100 of this embodiment includes cassette heaters 60A, 60B, 60C and an environmental heater 61 as heating means. The cassette heaters 60A, 60B, and 60C can be mounted to and dismounted from the mounting portions 29A, 29B, and 29C of the feeding portions 28A, 28B, and 28C, respectively. The mounting portions 29A, 29B, and 29C are provided above the feeding cassettes 1A, 1B, and 1C of the feeding portions 28A, 28B, and 28C, for example. The cassette heaters 60A, 60B, 60C are heaters for dehumidifying the recording materials 2 stored in the feeding portions 28A, 28B, and 28C and in the feeding cassettes 1A, 1B, 1C.

Figure 5A:
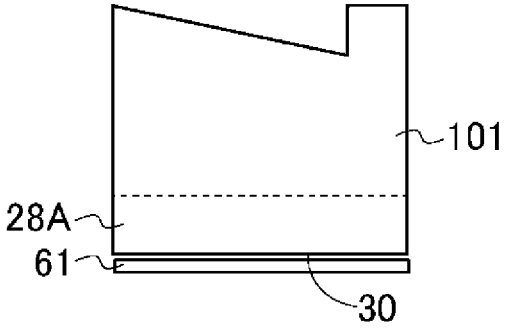
FIG. 5A is a schematic illustration showing a first example of an installation example of the environmental heater according to Embodiment 1.
Figure 5B:
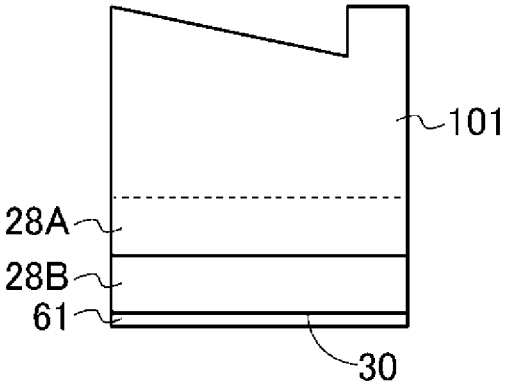
FIG. 5B is a schematic illustration showing a second example of the installation example of the environmental heater according to Embodiment 1.
Figure 5C:
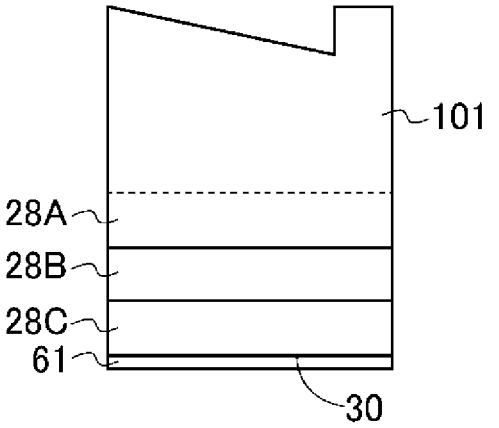
FIG. 5C is a schematic illustration showing a third example of the installation example of the environmental heater according to Embodiment 1.

As shown in FIGS. 5A-5C, the environmental heater 61 can be mounted to or dismounted from a mounting portion 30 of the feeding portion 28A, 28B or 28C. The mounting portion 30 is provided below the feeding portions 28A, 28B, and 28C, for example. The environmental heater 61 is a heater intended to prevent dew condensation in the image forming apparatus in addition to dehumidification of the recording material 2.

A cooling fan 40 as a cooling means is a fan for cooling the inside of the apparatus main assembly 101. In this embodiment, the cooling fan 40 is an exhaust fan which exhausts the air inside the apparatus main assembly 101 to the outside.

[Structure of Control Portion of Image Forming Apparatus]

Next, referring to the block diagram in FIG. 2, a system structure of the entire control portion of the image forming apparatus 100 will be described. The engine control portion 203 of the image forming apparatus 100 includes a video interface portion 204, a CPU (central processing unit) 205, a predicted developing device temperature detector 220, an in-machine cooling control portion 221, and an environmental temperature detector 222.

The controller portion 201 receives image information and an image formation command from a host computer 200, analyzes the received image information, and converts it into bit data. Then, an image formation reservation command, an image formation start command, and a video signal are fed to the engine control portion 203 by way of the video interface portion 204.

The CPU 205 as a control means outputs information to various actuators based on information acquired from various sensors to complete the image forming operation. The CPU 205 includes a ROM 206 storing program codes and data, and a RAM 207 used for temporary data storage.

In addition, the CPU 205 outputs a signal to rotate the belt drive motor 211, a first drum drive motor 212, and a second drum drive motor 213. The belt drive motor 211 drives a driving roller 18 (FIG. 1) which is one of the rollers stretching the intermediary transfer belt 12. The intermediary transfer belt 12 rotated by the driving roller 18. The second drum drive motor 213 drives the photosensitive drums 5Y, 5M, and 5C of the image forming stations PY, PM, and PC.

A cassette heater presence absence detection sensors 214A, 214B, and 214C as mounting detection means detect whether or not the cassette heaters 60A, 60B, and 60C are mounted on the mounting portions 29A, 29B, and 29C of the feeding portions 28A, 28B, and 28C, respectively. This information is outputted to the CPU 205. When the CPU 205 detects the mounting of the cassette heaters 60A, 60B, and 60C from this information, it outputs a signal to switch the cassette heaters 60A, 60B, and 60C into a heating state.

The environmental heater presence/absence detection sensor 215 as the mounting detection means detects information on whether or not the environmental heater 61 is mounted to the mounting portion 30 of any of the feeding portions 28A, 28B, and 28C. This information is outputted to the CPU 205. When the CPU 205 detects the mounting of the environmental heater 61 from this information, the CPU 205 outputs a signal to switch the environmental heater 61 into a heating state.

An environment sensor 39 as temperature detection means detects a temperature signal and a humidity signal as environmental information and outputs them to the CPU 205. The environmental temperature detector 222 detects temperature data on the basis of the output signal from the environment sensor 39.

The details will be described hereinafter, but in the predicted developing device temperature detector 220, a predicted temperature in the neighborhood of the developing device is detected on the basis of the environmental temperature detected by the environmental temperature detector 222 and the detected information of the cassette heater presence/absence detection sensor 214 and the environmental heater presence/absence detection sensor 215.

The in-machine cooling control portion 221 cools the inside of the apparatus main assembly 101 by outputting a signal to the cooling fan 40 to drive the fan in response to the predicted temperature in the neighborhood of the developing device detected by the developing device predicted temperature detecting portion 220.

[Structure of Cassette Heater]

Next, referring to FIGS. 1-3, the cassette heaters 60A, 60B, and 60C to be installed in feeding sections 28A, 28B, and 28C, will be described. The cassette heaters 60A, 60B, 60C have the same structures, and therefore, as a representative, the cassette heater 60A will be described. FIG. 3 is a perspective view illustrating the structure of the cassette heater 60A. The cassette heater 60A includes a cassette heater plate 302, a cassette heater unit 300 and a cassette heater power supply unit 303 provided below the cassette heater plate 302. Cassette heater holders 301*a*, 301*b*, 301*c*, and 301*d* are provided at the ends of the cassette heater plate 302, respectively.

When mounting the cassette heater 60A to the feeding portion 28A, the cassette heater plate 302 is mounted to the mounting portion 29A provided on the upper portion of the feeding portion 28A by the cassette heater holders 301*a*, 301*b*, 301*c*, and 301*d*. And, by the heat of the cassette heater unit 300 provided at the bottom of the cassette heater plate 302, the dehumidification of the recording material 2 stored in the feeding cassette 1A and the feeding portion 28A is effected.

In addition, the cassette heater power supply unit 303 supplies power to the cassette heater unit 300. The cassette heater power supply unit 303 includes a cassette heater presence/absence detection sensor 214 for detecting the connection of the cassette heater 60A inside, a switch circuit which switches between supplying and stopping power in response to instructions from the CPU 205 (FIG. 2).

[Structure of Environmental Heater]

Figure 4:
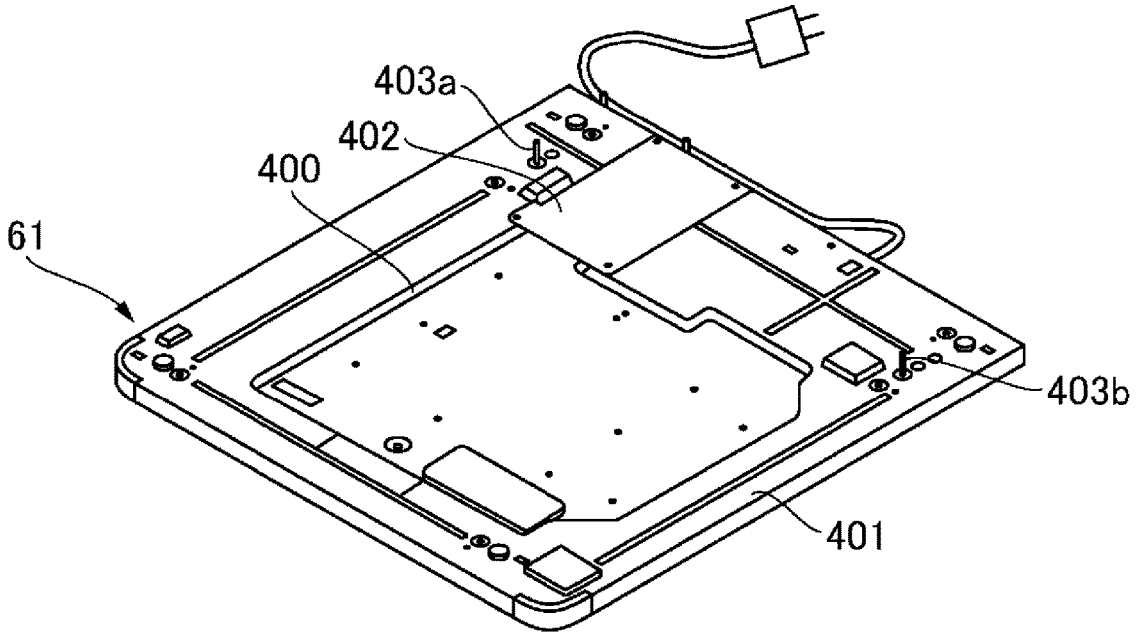
FIG. 4 is a perspective view of an environmental heater in Embodiment 1.

Next, referring to FIG. 1 and FIG. 4 the structure of the environmental heater 61 to be mounted on the mounting portion 30 of any of the feeding units 28A, 28B, 28C, will be described. FIG. 4 is a perspective view illustrating the structure of the environmental heater 61. The environmental heater 61 includes an environmental heater frame 401, an environmental heater unit 400, and an environmental heater power unit 402. Positioning pins 403*a* and 403*b* are provided on the upper surface of the environmental heater frame 401 so as to project upward.

When mounting the environmental heater 61 to the mounting portion 30, the environmental heater frame 401 is mounted to the mounting portion 30 by inserting the positioning pins 403*a* and 403*b* into the positioning holes provided in the bottom surface of the mounting portion 30. In this state, the environmental heater 61 is mounted to the lowermost portion of the image forming apparatus 100. And, by the heat of the environmental heater unit 400 provided in the environmental heater frame 401, the dehumidification inside the apparatus main assembly 101 and dehumidification of the recording material 2 are effected.

In addition, the environmental heater power unit 402 supplies electric power to the environmental heater unit 400. The environmental heater power unit 402 is provided inside thereof with the environmental heater presence/absence detection sensor 215 which detects the connection of the environmental heater 61, the switch circuit which switches between supplying and stopping power according to instructions from the CPU 205 (FIG. 2).

Referring to FIGS. 5A-C, a mounting pattern of the environmental heater 61 in this embodiment will be described. FIG. 5A is an illustration of a state in which the environmental heater 61 is mounted to an image forming apparatus which is provided only with the feeding portion 28A which is a standard feeder as the feeding portion. FIG. 5B is an illustration of a state in which the environmental heater 61 is mounted to the image forming apparatus provided with the feeding portion 28A as the standard feeder and the feeding portion 28B as an optional feeder. FIG. 5C is an illustration of a state in which the environmental heater 61 is mounted to the image forming apparatus provided with the feeding portion 28A as the standard feeder and the feeding portions 28B and 28C as the optional feeders. As described above, the environmental heater 61 is mounted to the lowermost portion of the image forming apparatus as necessary.

[Structure of Environmental Sensor]

Figure 6:
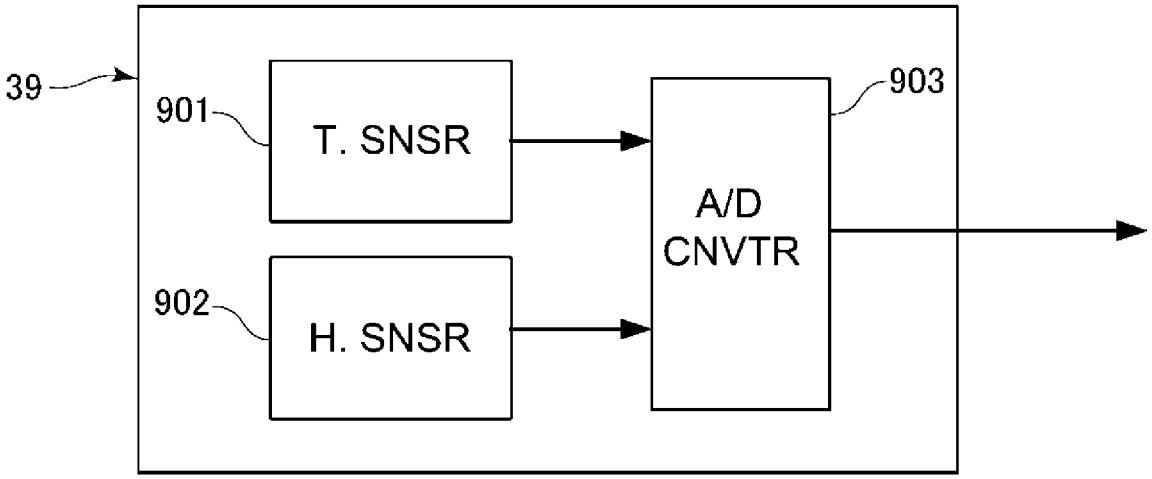
FIG. 6 is a block diagram showing a structure of the environmental heater according to Embodiment 1.

Next, referring to FIG. 6 the structure of environment sensor 39 will be described. The environment sensor 39 includes a temperature detector 901, a humidity detection portion 902, and an A/D converter portion 903. The temperature detector 901 detects the temperature in the neighborhood of the location where the environment sensor 39 is installed. The detection signal detected by the temperature detector 901 is inputted to the A/D converter portion 903. The humidity detector 902 detects the humidity in the neighborhood of the location where the environment sensor 39 is installed. The detection signal detected by the humidity detector 902 is inputted to the A/D converter portion 903. the A/D converter portion 903 performs A/D conversion of the input signal and outputs the converted signal. The output signal is read by the CPU 205 (FIG. 2). The CPU 205 selectively reads out the temperature data and humidity data every predetermined time period, and the read data is stored in the RAM 207 (FIG. 2).

Figure 2:
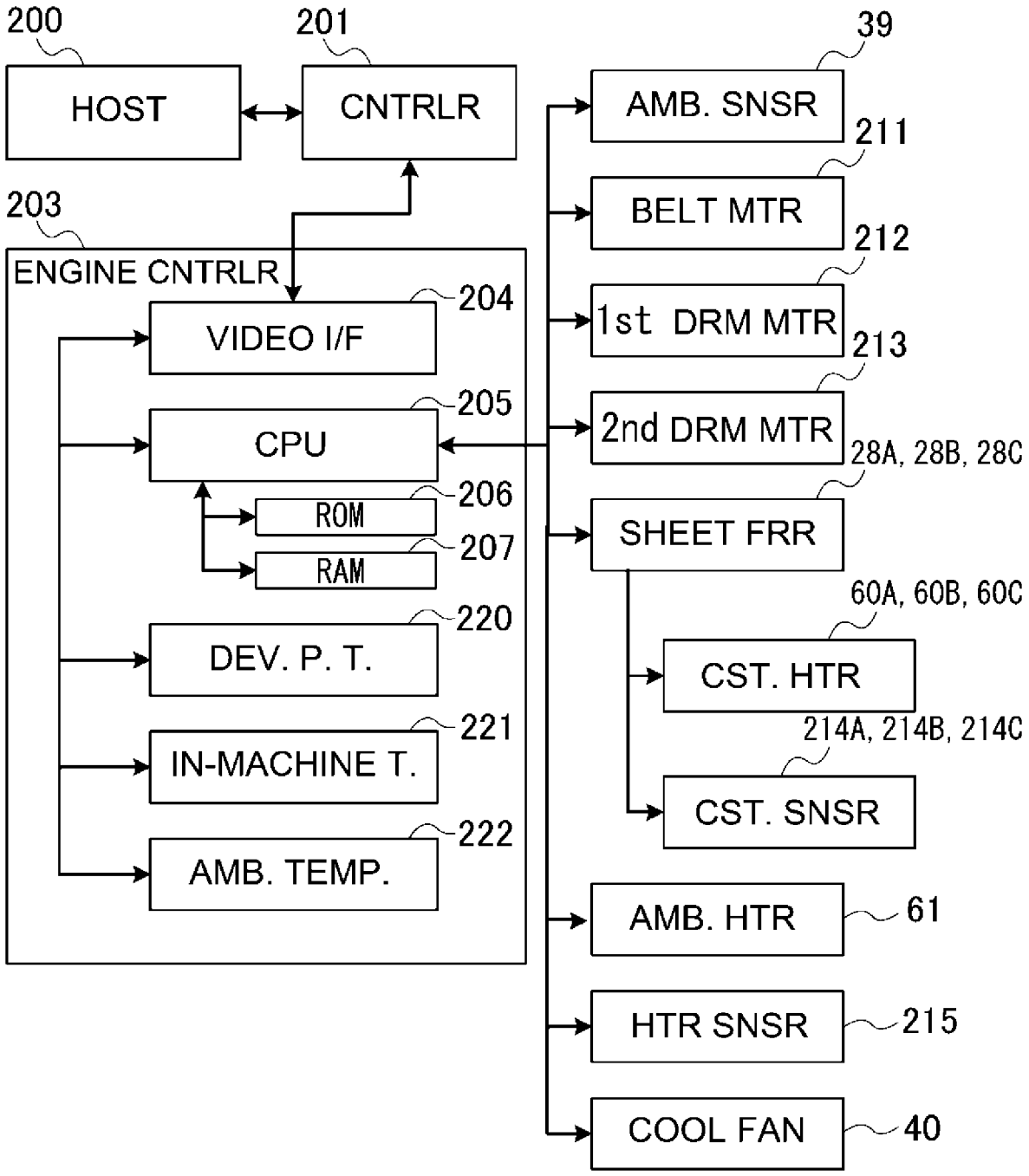
FIG. 2 is a control block diagram of the image forming apparatus according to Embodiment 1.
Figure 3:
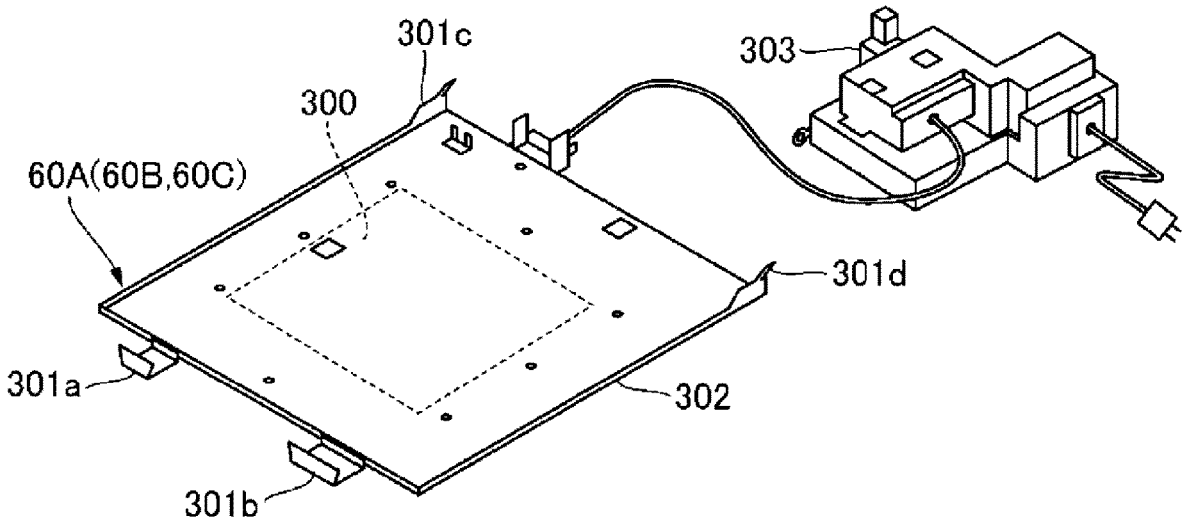
FIG. 3 is a perspective view of a cassette heater in Embodiment 1.

The environmental temperature detector 222 shown in FIG. 2 calculates temperature data Te from the temperature detection signal stored in the RAM 207. The calculated temperature data Te is stored in the RAM 207 and is used with the temperature prediction control in the neighborhood of the developing device which will be described hereinafter.

As shown in FIG. 1, the environment sensor 39 is disposed on the opposite side across the image forming portion 110 from the feeding portions 28A, 28B, and 28C in the vertical direction, in the apparatus main assembly 101. In particular, in this embodiment, the distances from the cassette heaters 60A, 60B and 60C and the environmental heater 61 to the environment sensor 39 are larger than the distances from the cassette heaters 60A, 60B and 60C and the environmental heater 61 to the developing devices 8Y, 8M, 8C and 8K. That is, in this embodiment, the developing portions 8Y, 8M, 8C, and 8K are disposed closer to the cassette heaters 60A, 60B, and 60C and the environmental heater 61 than the environment sensor 39 is.

[Temperature Prediction Control in the Neighborhood of the Developing Device]

In this embodiment, in order to prevent the temperature in the neighborhood of the developing portion from rising due to the image forming operation with the result of the deterioration of the toner in the developing portions 8Y, 8M, 8C, and 8K, the temperature Td in the neighborhood of the developing portion is predicted. Here, the deterioration of the toner is the phenomenon, for example, that the toner in the developing devices 8Y, 8M, 8C, and 8K is melted due to the rising of the temperature in the neighborhood of the developing device. And, when the predicted temperature Td exceeds a predetermined threshold temperature Th, the CPU 205 interrupts the image forming operation and cools the inside of the apparatus main assembly 101. That is, on the basis of the detection result of the environment sensor 39, the CPU 205 can start the operation of the cooling fan 40 and can stop the image forming operation of the image forming portion 110.

First, the calculation of the predicted temperature Td in the neighborhood of the developing device will be described. The predicted developing device temperature detector 220 shown in FIG. 2 determines, as the predicted temperature Td near the developing device, the addition of the temperature data Te detected by the environmental temperature detector 222 at predetermined time intervals, and the predicted temperature rise C near the developing device due to the operation of the image forming apparatus. That is.

$$Td=Te+C \quad (1).$$

The calculation result is stored in RAM 207.

$$C=C+C' \quad (2).$$

The stored data is renewed every time.

The calculation is made by $$C'=k\times(Cx-C) \quad (3)$$

wherein C' is a predicted temperature rise convergent value Cx and a temperature fluctuation rate k.

The predicted temperature rise convergent value Cx is the convergence value of the temperature rise. For example, when image formation starts at a predetermined temperature, the temperature inside the device rises, and after a certain amount of time, the temperature converges to the second temperature higher than the first temperature. The predicted temperature rise convergent value Cx is a value obtained by subtracting the first temperature from the second temperature. Temperature fluctuation rate k is a coefficient which represents the degree of the expected temperature rise per unit time.

C' is the temperature of the portion where the temperature rises at regular intervals, but as shown in equation (3), it is obtained by subtracting the current temperature rise portion (C) from the convergence temperature (Cx) of the temperature rise portion and multiplying by the coefficient (k) for raising the temperature in the period of the interval.

The above-described predicted temperature rise convergent value Cx and temperature fluctuation rate k are experimentally determined in advance according to the operating conditions or the like of the image forming apparatus. In this embodiment, the predicted temperature rise convergent value Cx and the temperature fluctuation rate k are stored in the ROM 206 as a table. FIG. 7A shows a table of the predicted temperature rise convergent value Cx and the temperature fluctuation rate k stored in the ROM 206.

Column 801 in FIG. 7A shows the state of the image forming apparatus, and is classified into "Image forming" performing image forming operation, "Standby" waiting for the start of image formation, "Sleep" when image formation is not performed, and the power consumption is lower than that in the standby mode.

A column 802 indicates an image forming speed during image formation, and is classified into "1/1 speed", "½ speed", and "⅓ speed" depending on the type of the designated recording material.

A column 803 is the color modes at the time of image formation. The color mode is based on the image data to be formed, and is classified into "Full Color" mode, in which image forming stations PY, PM, PC, PK are operated to form images "Monochrome" mode for image formation, in which only the image forming station PK are operated.

Column 804 is the predicted temperature rise convergent value Cx, column 805 is the temperature fluctuation rate k, and values are determined according to combinations of column 801, column 802, and column 803, respectively.

The temperature in the neighborhood of the developing device rises due to the image forming operation, and therefore, the predicted temperature rise convergent value Cx is set to a larger value in the "image forming" state than in the "standby" state and the "sleeping" state. In addition, in the "image forming" state, the higher the image forming speed, the higher the temperature rise by driving each motor, and therefore, the predicted temperature rise convergent value Cx increases. In addition, the "full color" mode operates more parts and members than the "monochrome" mode, and therefore, the value of Cx increases.

Here, in FIG. 7A, at "1/1 speed", the value of "k" is larger in monochrome than in full color this is because the time until the temperature converges is faster in monochrome than in full color, and therefore, as a result, the value of k is larger in the monochromatic mode. However, this depends on the devices.

In this embodiment, as described above, the cassette heaters 60A, 60B, 60C and the environmental heater 61 are mountable and dismountable. Therefore, when at least one of these heaters is installed, the actual temperature in the neighborhood of the developing device rises due to the heat of the heater. In particular, in this embodiment, as mentioned above, the distance between the heater (60A, 60B, 60C, 61) and the environment sensor 39 is larger than the distance between the heater (60A, 60B, 60C, 61) and the developing device (8Y, 8M, 8C, 8K). For this reason, there is a difference between the predicted temperature rise C in the neighborhood of the developing device mentioned above and the actual temperature rise, and therefore, the inside of the main assembly may not be cooled at an appropriate timing during image formation.

Under the circumstances, in this embodiment, the CPU 205 as the control means determines whether or not the heater is mounted to the mounting portions 29A, 29B, 29C, 30 by cassette heater presence/absence detection sensors 214A, 214B, 214C and environmental heater presence/absence detection sensor 215. And, The operation start timing of the cooling fan 40 is made different between the mounting state in which it is detected by any heater presence/absence detection sensor that the heater is mounted on the mounting portion and the non-mounted state in which it is not detected that the heater is mounted on the mounting portion. More specifically, when image formation is performed by the image forming portion 110 under the same conditions (predetermined conditions) in the mounted state and the non-mounted state, the cooling fan 40 starts operating in the mounted state earlier than in the non-mounted state.

Here, the same conditions (predetermined conditions) mentioned above mean the job contents such as the temperature and humidity of the installation environment of the image forming apparatus 100, the image formed on the recording material by the image forming portion 110, and the type and number of recording materials or the like are the same. That is, in the embodiment described above, when the same image is formed on the same number of recording materials in the same environment, time from start of image forming job to the operation of cooling fan 40 is earlier when the cassette heaters 60A, 60B, 60C and/or the environmental heater 61 is installed than when they are not installed. That is, when the cassette heaters 60A, 60B, 60C and the environmental heater 61 are installed, the operation start timing of the cooling fan 40 is earlier than when the cassette heaters 60A, 60B, 60C and the environmental heater 61 are not installed.

This is because when cassette heaters 60A, 60B, 60C and environmental heater 61 are installed, the predicted temperature is corrected to a higher level, and therefore, the time to reach the threshold temperature is earlier than when the cassette heaters 60A, 60B, 60C and the environmental heater 61 are not installed. That is, the structure is such that The cooling fan 40 is operated at the lower detection result (temperature) of the environment sensor 39 when the cassette heaters 60A, 60B, 60C and the environmental heater 61 are installed, than when the cassette heaters 60A, 60B, 60C and the environmental heater 61 are not installed. Here, temperature detected by environment sensor 39 when cassette heater 60A, 60B, 60C and environmental heater 61 are not installed is an example of a first temperature, temperature detected by environment sensor 39 when cassette heaters 60A, 60B, 60C and environmental heater 61 are installed is an example of a second temperature that is lower than the first temperature.

In this embodiment, when starting the operation of the cooling fan 40, the CPU 205 stops (interrupts) the image forming operation. For this reason, when the image forming portion 110 performs image formation under the same conditions (predetermined conditions) in the mounted state and the non-mounted state, the CPU 205 stops the image forming operation earlier in the mounted state than in the non-mounted state. More specifically, the following control is performed.

First, in the calculation of C' by the above equation (3), the predicted temperature rise convergent value Cx is corrected in consideration of the influence of the heat of the heater. When any of the cassette heaters 60A, 60B, 60C and the environmental heater 61 is installed, the predicted correction temperature due to the heat of the heater is Cc, calculation is made by.

$$C'=k\times(Cx+Cc-C) \quad (4).$$

FIG. 7B shows a table of predicted correction temperature Cc values stored in the ROM 206. The predicted correction temperature Cc when the cassette heater 60A is mounted to the feeding unit 28A is 5.9° C. Similarly, the temperature is 3.0° C. When the cassette heater 60B is mounted to the feeding portion 28B, and 1.3° C. When the cassette heater 60C is mounted to the feeding portion 28C. In addition, the predicted correction temperature Cc of the pattern of FIG. 5A in which the environmental heater 61 is mounted on the lower side of the feeding portion 28A is 5.5° C. Similarly, in the case of the pattern of FIG. 5B in which the environmental heater 61 is mounted on the lower side of the feeding unit 28B, the temperature is 2.5° C. in the case of the pattern of FIG. 5C in which the environmental heater 61 is mounted on the lower side of the feeding unit 28C, the temperature is 0.9° C. In FIG. 7B, the heater closer to the developing device more affects the developing device, and therefore, the predicted correction temperature Cc is set as a large value. In addition, when a plurality of heaters are mounted, the predicted correction temperature Cc is determined as an addition value.

For example, in FIG. 5A, when cassette heater 60A is installed in feeding portion 28A, an environmental heater 61 is mounted on the lower side of the feeding unit 28A, and therefore, $$Cc=5.9+5.5.$$

In addition, in FIG. 5C, when the cassette heater 60A is installed in the feeding portion 28A, and the cassette heater 60C is installed in the feeding portion 28C, an environmental heater 61 is mounted on the lower side of the feeding portion 28C, and therefore, $$Cc=5.9+1.3+0.9.$$

Cc is determined as above.

[Cooling Control in Main Assembly]

A cooling operation when the predicted temperature Td in the neighborhood of the developing device exceeds a predetermined threshold temperature Th will be described. The in-machine cooling control portion 221 shown in FIG. 2 compares the predicted temperature Td in the neighborhood of the developing device with a predetermined threshold temperature Th at predetermined time intervals, and if the predicted temperature Td in the neighborhood of the developing device exceeds a predetermined threshold temperature Th, the image forming operation is interrupted and the cooling fan 40 is driven.

And, the cooling fan 40 discharge the heat in the neighborhood of the developing device to the outside of the apparatus to lower the temperature in the neighborhood of the developing device. While performing the cooling operation, the in-machine cooling control portion 221 compares the predicted temperature Td in the neighborhood of the developing device with the cooling stop threshold temperature Tr at predetermined time intervals. And, when the predicted temperature Td in the neighborhood of the developing device becomes lower than the cooling stop threshold temperature Tr, driving the cooling fan 40 is stopped, and the interrupted image forming operation is resumed. Here, the predetermined threshold temperature Th and the cooling stop threshold temperature Tr have a relationship of Tr<Th.

[Developer Temperature Rise Protection Control]

Next, using the flowchart of FIG. 8, the control for protecting the temperature rise in the neighborhood of the developing device in this embodiment will be described. This flowchart is stored in the ROM 206 and executed by the CPU 205.

When the image forming apparatus 100 is turned on, the structure of the heaters (cassette heaters 60A, 60B, 60C and environmental heater 61) mounted on the image forming apparatus 100 is acquired (S101). That is, CPU 205 detects whether the cassette heaters 60A, 60B, 60C and the environmental heater 61 are installed, on the basis of the signal from the cassette heater presence/absence detection sensor 214 and the signal from the environmental heater presence/absence detection sensor 215 of each mounting portion 29A, 29B, 29C. And, heating is started by the installed heater.

Next, the predicted correction temperature Cc is determined from the structure of the mounted heater or heaters (S102). That is, depending on the installed state of the cassette heater 60A, 60B, 60C and the environmental heater 61, the CPU 205 determines the predicted correction temperature Cc by the method described above using the table of FIG. 7B stored in the ROM 206, and stores it in the RAM 207.

Next, the CPU 205 determines whether a predetermined time (t seconds) has elapsed (S103). In this embodiment, the predicted temperature Td in the neighborhood of the developing device is updated every 5 seconds, and therefore, it is determined whether 5 seconds have elapsed (t=5). When t seconds have elapsed, the CPU 205 acquires temperature data Te from the environment sensor 39 stored in the RAM 207 (S104).

Next, the CPU 205 acquires the operation state of the image forming apparatus 100 (S105). As the operating state, it determines whether the above-mentioned "during image forming", "standby", or "sleeping", and in the case of "during image formation", the information on the image formation speed and color mode is acquired. Next, the CPU 205 obtains the predicted temperature rise convergent value Cx and the temperature fluctuation rate k (S106), using the table of FIG. 7A stored in the ROM 206 and the information acquired in step S105 and the operation state information of the image forming apparatus.

Next, using the predicted temperature rise convergent value Cx, the temperature fluctuation rate k acquired in step S106, and the predicted correction temperature Cc acquired in step S102, it calculates the predicted temperature Td in the neighborhood of the developing device (S107). Next, the CPU 205 determines whether or not the cooling operation of driving the cooling fan 40 is operating (S108).

If the cooling operation is not running (No, in step S108), the CPU 205 compares the predicted temperature Td in the neighborhood of the developing device calculated in step S107 with a predetermined threshold temperature Th (S109). In this embodiment, the value Th is 45 degree C., and if the predicted temperature Td in the neighborhood of the developing device is 45° C. Or lower (No, in step S109), the process proceeds to step S103 and the process is repeated.

On the other hand, in step S109, if the predicted temperature Td in the neighborhood of the developing device is greater than 45° C. (Yes, in step S109) the CPU 205 interrupts the image forming operation, drives the cooling fan 40 to start cooling the inside of the apparatus main assembly 101 (S110), and proceeds to step S103.

In addition, in step S108, when the cooling operation is running (Yes, in step S108), the CPU 205 compares the predicted temperature Td in the neighborhood of the developing device with the cooling stop threshold temperature Tr (S111). In this embodiment, the value of the cooling stop threshold temperature Tr is 40° C. if the predicted temperature Td in the neighborhood of the developing device is 40° C. Or higher (No, in step S111), the CPU 205 proceeds to step S103 while continuing the cooling operation.

According to such this embodiment, the cassette heaters 60A, 60B, 60C and the environmental heater 61 can be mounted to and dismounted from the feeding portions 28A, 28B, 28C it is possible to suppress the temperature in the neighborhood of the developing devices 8Y, 8M, 8C, and 8K from excessively rising. That is, in this embodiment, depending on whether the heater is installed or not, the predicted temperature in the neighborhood of the developing device is corrected, the start of driving of the cooling fan 40 and the interruption (stop) of the image forming operation are controlled. For this reason, the accuracy of the predicted temperature in the neighborhood of the developing device based on the temperature detected by the environment sensor 39 can be improved. by this, it is possible to suppress the temperature in the neighborhood of the developing device from excessively rising due to the heat of the heater or heaters.

In particular, in the case of the structure of this embodiment, the distance between the heater (60A, 60B, 60C, 61) and the environment sensor 39 is larger than the distance between the heater (60A, 60B, 60C, 61) and the developing device (8Y, 8M, 8C, 8K). For this reason, a deviation is likely to results between the predicted temperature rise C in the neighborhood of the developing device based on the detection result of the environment sensor 39 and the actual temperature rise. Therefore, as described above, depending on whether the heater is installed or not, the predicted temperature in the neighborhood of the developing device is corrected, by which the accuracy of the predicted temperature near the developing device can be further improved.

In addition, in this embodiment, by correcting the predicted temperature in the neighborhood of the developing device according to the number and position of the heaters mounted, the accuracy of the predicted temperature in the neighborhood of the developing device based on the temperature detected by the environmental sensor can be further improved.

Embodiment 2

Referring to FIG. 1 to FIG. 7, FIG. 9 and FIG. 10, Embodiment 2 will be described. In this embodiment, Further correction is made to the predicted correction temperature Cc in FIG. 7B, taking into account the heat that the recording material heated by the cassette heaters 60A, 60B, and 60C carries. Other structures and operations are the same as those in Embodiment 1, and therefore, the same elements are denoted by the same reference numerals, and the following description will focus on differences from Embodiment 1.

The recording material accommodated in the feeding portion equipped with the heater is heated by the heater. For this reason, the recording material fed from the feeding portion carries heat to the image forming portion 110. For this reason, this heat may further increase the temperature in the neighborhood of the developing device. Therefore, in this embodiment, the predicted correction temperature Cc is corrected to the predicted correction temperature Cc' in consideration of the heat carried by the recording material as described above.

More specifically, when the correction value of the predicted correction temperature is a.

$$Cc'=Cc+\alpha \quad (5).$$

The predicted correction temperature is corrected from Cc to Cc' using the above equation.

FIG. 9 shows a table of correction values a due to paper heat of the recording material stored in the ROM 206 is shown, and further, a correction value α of the predicted correction temperature corresponding to the feeding portion which has fed the recording material. The table in FIG. 9 is more affected by the heat carried by the recording material as the feeding portion is closer to the developing device, and therefore, the value is set larger.

Figure 10:
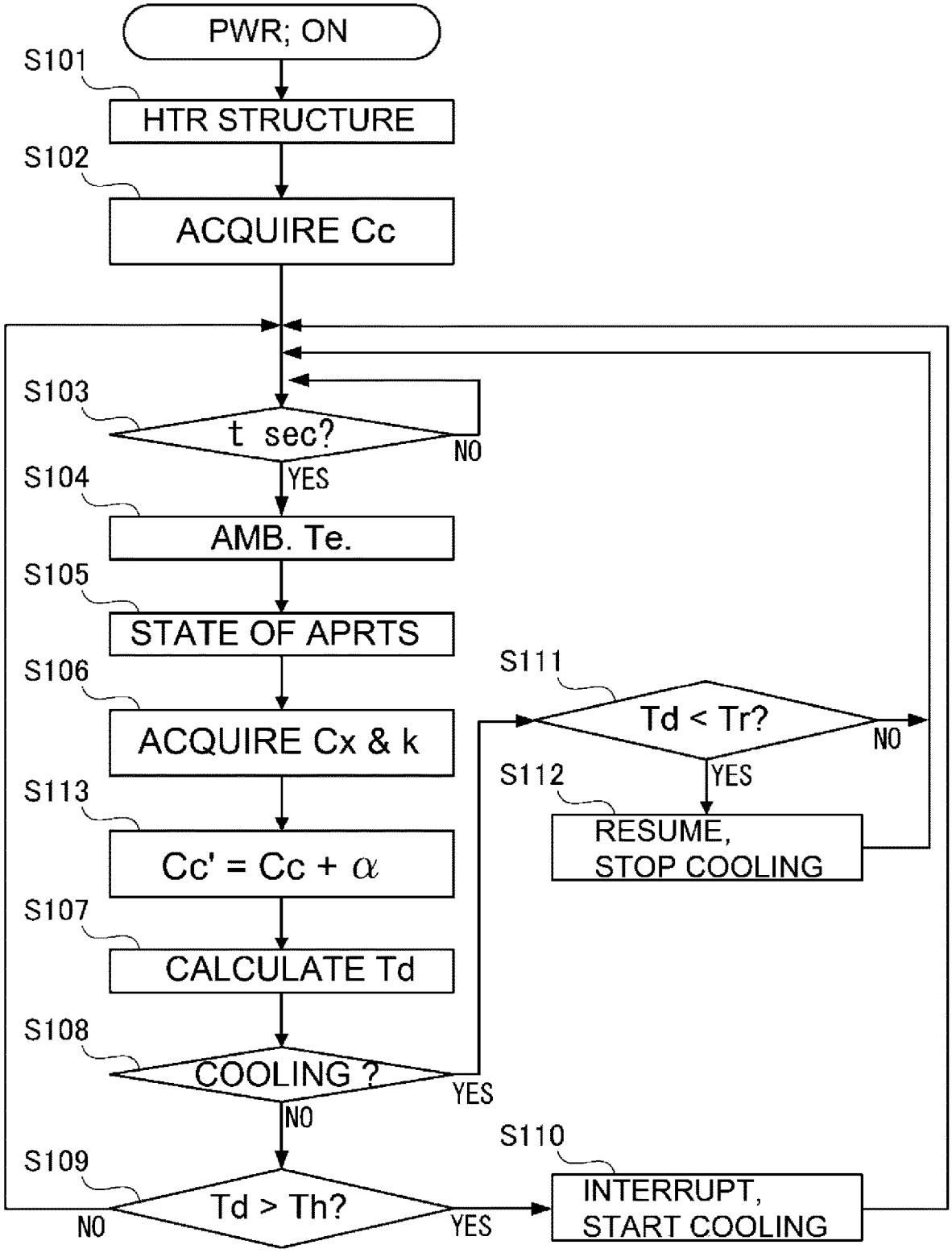
FIG. 10 is a flowchart of the temperature rise protection control according to Embodiment 2.

Next, the control for protecting the temperature rise in the neighborhood of the developing device in this embodiment, will be described with reference to the flowchart of FIG. 10. This flowchart is stored in the ROM 206 and executed by the CPU 205. Here, the flowchart of FIG. 10 is the same as that of FIG. 8 except that S113 is provided between the steps S106 and S107, as compared to the flowchart shown in FIG. 8.

When the CPU 205 acquires the predicted temperature rise convergent value Cx and the temperature fluctuation rate k in step S106, the CPU 205 corrects the predicted correction temperature Cc acquired in step S102 to Cc' (S113). More specifically, if the cassette heater is installed in the feeding portion which feeds the recording material in the "image forming" state, the correction value α in the tables of FIGS. 7A and 7B is added to Cc (Cc'=Cc+α). And, using this predicted correction temperature Cc', a predicted temperature Td in the neighborhood of the developing device is calculated (S107). That is, "C'" is obtained by setting "Cc" in the above equation (4) to "Cc'", and "Td" is calculated using equations (1) and (2).

Here, if the recording material is fed from a feeding portion which is not equipped with the cassette heater, this is the same as the control in Embodiment 1 described above.

As described above, in the case of this embodiment, when feeding the recording material from the feeding portion where the cassette heater is installed, The predicted correction temperature Cc is updated to Cc', considering the heat which is carried by the recording material when the recording material is heated by the cassette heater. For this reason, based on the temperature detected by the environment sensor 39, the accuracy of the predicted temperature near the developing device is improved the toner deterioration due to temperature rise near the developing device can be protected.

Other Embodiments

In each of the embodiments described above, based on the detection result of the environment sensor 39, the CPU 205 starts the operation of the cooling fan 40 and stops the image forming operation of the image forming portion 110. However, the present invention is also applicable to a structure which does not include a cooling fan. In such a case when image formation is performed by the image forming portion 110 under the same conditions (predetermined conditions) in the mounted state and the non-mounted state, the CPU 205 stops the image forming operation in the mounted state earlier than in the non-mounted state. If the image forming operation is stopped, further temperature rise in the device can be suppressed, and therefore, the temperature rise in the neighborhood of the developing device can be suppressed. In this case, the control to stop the image forming operation is the cooling operation.

Here, even if a cooling fan is provided, only the stopping of the image forming operation may be carried out, in some cases. Or, in the structure including the cooling fan, based on the detection result of the environment sensor 39, only the operation of the cooling fan may be started without stopping the image forming operation.

In addition, as the cooling operation within the main assembly of the apparatus, not only the image forming operation is stopped, but also other methods such as reducing the image forming speed while continuing the image forming operation or widening the interval between the recording materials to be conveyed, or another method may be used as the cooling operation in effect.

In addition, in each of the embodiments described above, the CPU 205 detects whether the cassette heaters 60A, 60B, 60C, and the environmental heater 61 are installed, based on the signal from the cassette heater presence/absence detection sensor 214 and the signal from the environmental heater presence/absence detection sensor 215, it has been explained that the heating is started by the installed heater. However, in the present invention, in addition to the heater presence/absence detection sensor, there may be provided a heating start/stop means for each heater such as a switch, and the correction may be performed for a heater that is mounted and operating.

In addition, in each of the above embodiments, the CPU 205 has been described as detecting whether cassette heater 60A, 60B, 60C and/or environmental heater 61 is installed on the basis of the signal from the cassette heater presence/absence detection sensor 214 and the signal from the environmental heater presence/absence detection sensor 215. However, in the present invention, it will suffice if the structure is such as to detect the presence/absence of each of the cassette heaters 60A, 60B, 60C and the environmental heater 61 on the basis of information inputted from an operation panel (not shown) provided in the image forming apparatus 100, instead of detection by a sensor. In addition, it is also possible to detect the presence or absence of cassette heaters 60A, 60B, 60C, and environmental heater 61 based on information inputted from an external device such as a PC connected to the image forming apparatus 100 by way of an interface or the like, not from an operation panel (not shown). In this case, the information regarding the presence or absence of a heater inputted from an operation panel (not shown) or an external device is stored in a storing portion such as the RAM 207. The CPU 205 may be constituted to detect the presence/absence of each of the cassette heaters 60A, 60B, 60C, and the environmental heater 61 by reading information on the presence/absence of the heater stored in the storage portion.

In addition, in each of the embodiments described above, when the predicted temperature Td in the neighborhood of the developing device predicted based on the detection result of the environment sensor 39 is higher than the threshold temperature Th, the operation of the cooling fan 40 is started. However, the present invention may be applied to a device which constantly rotates the cooling fan 40 at a low speed, and when the predicted temperature Td is higher than the threshold temperature Th, the cooling operation is executed by increasing the rotational speed of the cooling fan 40 as compared with the case where the predicted temperature Td is equal to or lower than the threshold temperature Th. In this case, when the predicted temperature td is lower than the threshold temperature Tr, the rotational speed of the cooling fan 40 is lowered as compared with the case where the predicted temperature Td is higher than the threshold temperature Th.

In addition, in each embodiment described above, by correcting the predicted temperature Td based on the presence or absence of the cassette heaters 60A, 60B, 60C and the environmental heater 61, the cooling fan 40 is operated in a state in which the detection result (temperature) of the environment sensor 39 is lower when the heater is mounted, than when the heater is not mounted. However, other structures may be used to achieve the same effect. For example, the threshold temperature Th may be changed based on the presence or absence of the cassette heaters 60A, 60B, 60C and the environmental heater 61. In this case, the threshold temperature Th when the heater is mounted is set lower than the threshold temperature Th when the heater is not mounted. In addition, the threshold temperature Th when the position of the mounted heater is close to the developing device 8 is lower than the threshold temperature Th when the heater position is remote from the developing device 8. As described above, the cooling fan 40 may be operated in a state in which the detection result (temperature) of the environment sensor 39 is lower when the heater is mounted, than when the heater is not mounted. Here, the threshold temperature Th may be changed according to the number of heaters. At this time, the threshold temperature Th when the cassette heaters 60A, 60B, 60C and the environmental heater 61 are not installed is an example of the first temperature, the threshold temperature Th when cassette heaters 60A, 60B, 60C and environmental heater 61 are installed is an example of a second temperature which is lower than the first temperature.

Effect of the Invention

According to the present invention, it is possible to prevent the temperature in the neighborhood of the developing device from rising excessively with a structure in which the heating unit is mountable to and dismountable from the recording material storage portion.

While the present invention has been described with reference to exemplary embodiments, it is to understood that the invention is not limited to the disclosed exemplary embodiments. The scope of the following claims is to be accorded the broadest interpretation so as to encompass all such modifications. And equivalent structures and functions.

This application claims the benefit of Japanese Patent Applications Nos. 2018-224212 filed on Nov. 29, 2018 and 2019-206512 filed on Nov. 14, 2019, which are hereby incorporated by reference herein in their entirety.

What is claimed is:

1. An image forming apparatus capable of executing an image forming operation for forming an image on a recording material, said image forming apparatus comprising:

an image forming unit including a photosensitive member, a developing device capable of developing an electrostatic latent image formed on said photosensitive member with a developer, wherein the image provided by the development by said developing device is transferred onto a recording material;

a temperature detector configured to detect an environment temperature at which said image forming apparatus is installed;

an accommodating portion configured to accommodate recording materials to be fed to said image forming unit, wherein a heating unit configured to heat the recording material is detachably mountable to said accommodating portion;

a cooling unit configured to cool said developing device;

a controlling unit configured to execute a cooling operation of said cooling unit on the basis of a detection result of said temperature detection unit;

wherein in a case that said heating unit is not mounted in said accommodating portion, said controlling unit executes the cooling operation of said cooling unit when the detection result of said temperature detector indicates a temperature not less than a first temperature, and in a case that said heating unit is mounted in said accommodating portion, said controlling unit executes the cooling operation when the detection result of said temperature detector indicates a temperature not less than a second temperature which is lower than the first temperature.

2. An apparatus according to claim 1, further comprising a mounting detecting sensor configured to detect presence or absence of said heating unit mounted in said accommodating portion, wherein said controlling unit determines the presence or absence of said heating unit on the basis of a detection result of said mounting detecting sensor.

3. An apparatus according to claim 1, further comprising a storing portion configured to store information relating to presence or absence of said heating unit, wherein said controlling unit determines the presence or absence of said heating unit on the basis of the information stored in said storing portion.

4. An apparatus according to claim 1, wherein in a case that said heating unit is mounted in said mounting portion, said controlling unit stops the image forming operation of said image forming unit when the detection result of said temperature detector it is not less than the first temperature, and in a case that said heating unit is not mounted in said mounting portion, said controlling unit stops the image forming operation of said image forming unit when the detection result of said temperature detector is not less than the second temperature.

5. An apparatus according to claim 1, wherein when the cooling operation of said cooling unit be executed, said controlling unit stops the image forming operation of said image forming unit.

6. An apparatus according to claim 1, wherein when the detection result of said temperature detector become indicating a third temperature which is lower than the first temperature, said controlling unit stops the cooling operation of said cooling unit.

7. An apparatus according to claim 1, wherein said controlling unit calculates a predicted temperature in the neighborhood of said developing device from the detection result of said temperature detector, and when the predicted temperature exceeds a threshold temperature, said controlling unit executes the cooling operation of the cooling unit, wherein said controlling unit calculates the predicted temperature such that the predicted temperature in the case that the heating unit is mounted in said accommodating portion is higher than the predicted temperature in the case that said heating unit is not mounted in said accommodating portion.

8. An apparatus according to claim 1, wherein said controlling unit calculates a predicted temperature in the neighborhood of said developing device from the detection result of said temperature detector, and when the predicted temperature exceeds a threshold temperature, said controlling unit executes the cooling operation of the cooling unit, wherein the threshold temperature in the case that said heating unit not mounted in said accommodating portion is the first temperature, and the threshold temperature in the case that the heating unit is mounted in said accommodating portion is the second temperature.

9. An apparatus according to claim 7, wherein said accommodating portion includes a first cassette accommodating the recording materials to be fed to said image forming unit, and a second cassette accommodating the recording materials to be fed to the image forming unit, said second cassette being below the first cassette, wherein a first heating unit configured to heat the recording material in said first cassette and detachably mountable to said first cassette, and a second heating unit configured to heat the recording material in said second cassette and detachably mountable to said second cassette, wherein said controlling unit calculates the predicted temperature such that the predicted temperature in a case that said first heating unit is mounted to said first cassette is higher than the predicted temperature in a case that said second heating unit is mounted to said second cassette.

10. An apparatus according to claim 8, wherein said accommodating portion includes a first cassette accommodating the recording materials to be fed to said image forming unit, and a second cassette accommodating the recording materials to be fed to the image forming unit, said second cassette being below the first cassette, wherein a first heating unit configured to heat the recording material in said first cassette and detachably mountable to said first cassette, and a second heating unit configured to heat the recording material in said second cassette and detachably mountable to said second cassette, wherein the threshold temperature in a case that said first heating unit is mounted to said first cassette is higher than the threshold temperature in a case that said second heating unit is mounted to said second cassette.

11. An apparatus according to claim 1, wherein said cooling unit includes a discharge fan configured to discharge air in said image forming apparatus to an outside.

12. An apparatus according to claim 1, wherein a distance between said heating means and said temperature detector is larger than a distance between said heating means and said developing means.

13. An image forming apparatus capable of executing an image forming operation for forming an image on a recording material, said image forming apparatus comprising:

an image forming unit including a photosensitive member, a developing device capable of developing an electrostatic latent image formed on said photosensitive member, with a developer, wherein the image provided by the development by said developing device is transferred onto a recording material;

a temperature detector configured to detect an environment temperature at which said image forming apparatus is installed;

an accommodating portion configured to accommodate a recording material to be fed to said image forming unit;

a controlling unit configured to stop the image forming operation on the basis of a detection result of said temperature detector, wherein in a case that said heating unit is not mounted in said mounting portion, said controlling unit stops the image forming operation of said image forming unit when the detection result of said temperature detector it is not less than a first temperature, and in a case that said heat unit is mounted in said mounting portion, said controlling unit stops the image forming operation of said image forming unit when the detection result of said temperature detector is not less than a second temperature which is lower than the first temperature.

14. An apparatus according to claim 13, further comprising a mounting detecting sensor configured to detect presence or absence of said heating unit mounted in said accommodating portion, wherein said controlling unit determines the presence or absence of said heating unit on the basis of a detection result of said mounting detecting sensor.

15. An apparatus according to claim 13, further comprising a storing portion configured to store information relating to presence or absence of said heating unit, wherein said controlling unit determines the presence or absence of said heating unit on the basis of the information stored in said storing portion.

16. An apparatus according to claim 13, wherein said controlling unit calculates a predicted temperature in the neighborhood of said developing device from the detection result of said temperature detector, and when the predicted temperature exceeds a threshold temperature, said controlling unit stops the image forming operation, wherein said controlling unit calculates the predicted temperature such that the predicted temperature in the case that the heating unit is mounted in said accommodating portion is higher than the predicted temperature in the case that said heating unit is not mounted in said accommodating portion.

17. An apparatus according to claim 13, wherein said controlling unit calculates a predicted temperature in the neighborhood of said developing device from the detection result of said temperature detector, and when the predicted temperature exceeds a threshold temperature, said controlling unit stops the image forming operation, wherein the threshold temperature in the case that said heating unit not mounted in said accommodating portion is the first temperature, and the threshold temperature in the case that the heating unit is mounted in said accommodating portion is the second temperature.

18. An apparatus according to claim 16, wherein said accommodating portion includes a first cassette accommodating the recording materials to be fed to said image forming unit, and a second cassette accommodating the recording materials to be fed to the image forming unit, said second cassette being below the first cassette, wherein a first heating unit configured to heat the recording material in said first cassette and detachably mountable to said first cassette, and a second heating unit configured to heat the recording material in said second cassette and detachably mountable to said second cassette, wherein said controlling unit calculates the predicted temperature such that the predicted temperature in a case that said first heating unit is mounted to said first cassette is higher than the predicted temperature in a case that said second heating unit is mounted to said second cassette.

19. An apparatus according to claim 17, wherein said accommodating portion includes a first cassette accommodating the recording materials to be fed to said image forming unit, and a second cassette accommodating the recording materials to be fed to the image forming unit, said second cassette being below the first cassette, wherein a first heating unit configured to heat the recording material in said first cassette and detachably mountable to said first cassette, and a second heating unit configured to heat the recording material in said second cassette and detachably mountable to said second cassette, wherein the threshold temperature in a case that said first heating unit is mounted to said first cassette is higher than the threshold temperature in a case that said second heating unit is mounted to said second cassette.

20. An apparatus according to claim 13, wherein a distance between said heating means and said temperature detector is larger than a distance between said heating means and said developing means.

* * * * *